United States Patent [19]

Williams et al.

[11] 4,236,399

[45] Dec. 2, 1980

[54] METHOD OF FORMING A PARABOLIC TROUGH

[76] Inventors: Orlan G. Williams, 3800 S. Decatur Blvd., #36, Las Vegas, Nev. 89103; Robert L. Skaggs, 1106 Commanche Way, Boulder City, Nev. 89005

[21] Appl. No.: 947,358

[22] Filed: Oct. 2, 1978

[51] Int. Cl.[3] ..... B21D 11/20

[52] U.S. Cl. ..... 72/295; 72/298; 72/377; 113/116 J; 148/131

[58] Field of Search ..... 72/295, 298, 305, 308, 72/310, 311, 342, 364, 379, 702; 148/11.5 A, 12.7 A, 130, 131; 29/446; 113/116 J, 116 Y

[56] References Cited

U.S. PATENT DOCUMENTS

| | | | |
|---|---|---|---|
| 1,058,590 | 4/1913 | Hunker | 72/379 |
| 1,937,663 | 12/1933 | Norton | 72/379 |
| 2,095,533 | 10/1937 | Schmidt | 72/379 |
| 2,724,669 | 11/1955 | Quirolo et al. | 148/11.5 A |
| 3,004,584 | 10/1961 | Fuchs et al. | 72/298 |
| 3,490,405 | 1/1970 | Reader et al. | 72/364 |
| 3,585,836 | 8/1968 | Tate et al. | 72/364 |
| 3,761,322 | 9/1973 | Winter et al. | 148/11.5 A |
| 3,887,976 | 6/1975 | Sheilds | 29/446 |
| 3,975,816 | 8/1976 | Carter | 29/446 |

*Primary Examiner*—Lowell A. Larson
*Attorney, Agent, or Firm*—Seiler & Quirk

[57] ABSTRACT

Solar parabolic reflecting troughs are formed from long strips of sheet metal by applying equal bending moments to each long edge of the strip to draw the metal into a parabolic shape. While maintaining the metal in parabolic form, the trough is stress relieved by heating.

9 Claims, 3 Drawing Figures

METHOD OF FORMING A PARABOLIC TROUGH

1. FIELD OF THE INVENTION

This invention relates to forming methods for solar parabolic troughs from sheet metal. More particularly, it relates to a metal forming method which comprises applying forces and moments to a substantially flat piece of sheet metal to draw the metal into a parabolic shape, and subsequently heating the metal while retaining its desired shape under conditions sufficient to relieve stress in the metal. The resulting product has a very accurate parabolic cross-section, and does not need structural supports to retain its shape.

2. DESCRIPTION OF THE PRIOR ART

History records technological use of solar energy by man over 2500 years ago. Widespread commercial use of solar energy has never been attained, first because of the lack of adequate technology, and more recently, because of an abundance of low cost alternatives, such as fossil fuels. Within the last decade, efficient use of solar energy has again become the focus of concentrated research efforts, due to the imminent depletion and rapidly rising prices of oil and gas resources.

A common way of capturing the sun's energy is through the use of a solar collector, wherein solar heat is transmitted to a fluid carried by a conduit traversing the collector. More efficient collectors take the form of an elongated trough having a parabolic cross-section, with the fluid conduit oriented length-wise of the trough at the focal line of the parabola. With this arrangement, solar rays striking the reflective parabolic surface are concentrated at the focal line, where they are absorbed by the fluid heat transfer medium.

One of the main areas of potential for parabolic solar collectors is for residential and small commercial use. Up to the present time, such use has been limited, largely for economic reasons; cost of the entire system has not been justified relative to the cost of the continuing purchase of fossil fuels. While the efficiency of parabolic collectors is high, the cost has also been relatively high, largely because of either a complex forming process which is required to make a rigid, accurate parabolic structure, or because of the bulky framework or superstructure required to maintain the trough in truly parabolic shape. Some troughs are fabricated from a rigid material, such as an aluminum honeycomb sandwich, which is inherently expensive; others are formed by placing sheet metal in a mold, thereby forming it to the desired shape, and then attaching ribs, a box, or other structural backing members to hold the metal in its parabolic shape. Even with this structural backing, the trough occasionally assumes a wavy configuration due to stresses induced in the metal by the forming process at locations between the structural ribs.

Accordingly, there is a need for a parabolic trough-forming process which is both simple and inexpensive, and which produces a trough which maintains an accurate parabolic cross-section without extensive structural support. The process of the invention provides such a method, wherein an elongated piece of sheet metal is first bent into a parabolic shape by applying equal bending moments to each long side of the sheet metal, and subsequently stress relieving the metal by heating while the metal is retained in the parabolic shape.

The process of bending metal to curved shapes by applying bending moments thereto is not new. For example, Carter, U.S. Pat. No. 3,975,816, discloses a method of making a circular fiber-reinforced resin tank structure by forming a plurality of rigid sheets into adjacent arcuate sections having a degree of curvature equal to that of the external tank structure. Each sheet is formed to the desired curvature by means of turnbuckles attached to rigid connecting brackets at the vertical edges of the sheets, thereby effectively producing a bending moment at the edge of the sheet. The forming sections are then interconnected to form a large cylinder, and fiber-reinforced resin is laid up against the forming structure to make the tank structure. After the forming process is complete, the forming sections are removed. In this case, only very slight curvature is desired, with a constant radius being achieved.

Another metal forming technique is disclosed in Raynes, U.S. Pat. No. 2,753,915. According to Raynes, sheet metal is stretch-formed to a desired shape by a power driven actuating ram which stretches the metal over a curved dye.

The use of heat to relieve stress in metals which have been formed by bending is a well-known, widely commercially used process. However, its use to form accurate rigid parabolic structures formed by applying bending moments to sheet metal is believed novel.

Accordingly, it is an object of the invention to provide a simple, inexpensive forming process for parabolic sheet metal solar troughs. It is a further object of the invention to provide a stepwise process which comprises first bending elongated sections of sheet metal into a parabolic shape by applying bending moments to the edges of the sheets, and subsequently stress relieving said metal by heating the metal, while being held in parabolic shape, under appropriate stress relieving conditions.

SUMMARY OF THE INVENTION

A method of forming a parabolic trough comprises bending an elongated strip of sheet metal to a predetermined parabolic widthwise cross-section by applying equal bending moments to each lengthwise edge of the strip, and heating the strip to stress-relieve the metal while maintaining the strip in the desired parabolic shape.

BRIEF DESCRIPTION OF THE DRAWINGS

The invention is best understood with reference to the drawings, in which.

DETAILED DESCRIPTION OF THE INVENTION

Figure 2:
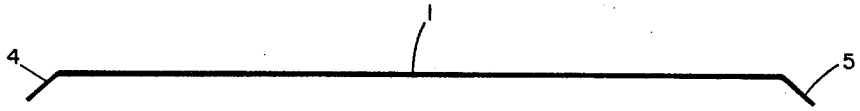
FIG. 2 is an end view of the sheet metal prior to bending.

Referring first to FIG. 2, the drawing shows an end view of an elongated piece of aluminum alloy 5052-H34, designated as 1, having one-half inch lips or flanges 4 and 5 on each side. The sheet metal has a width of about 12 inches, and a length of about 8 feet.

Figure 1:
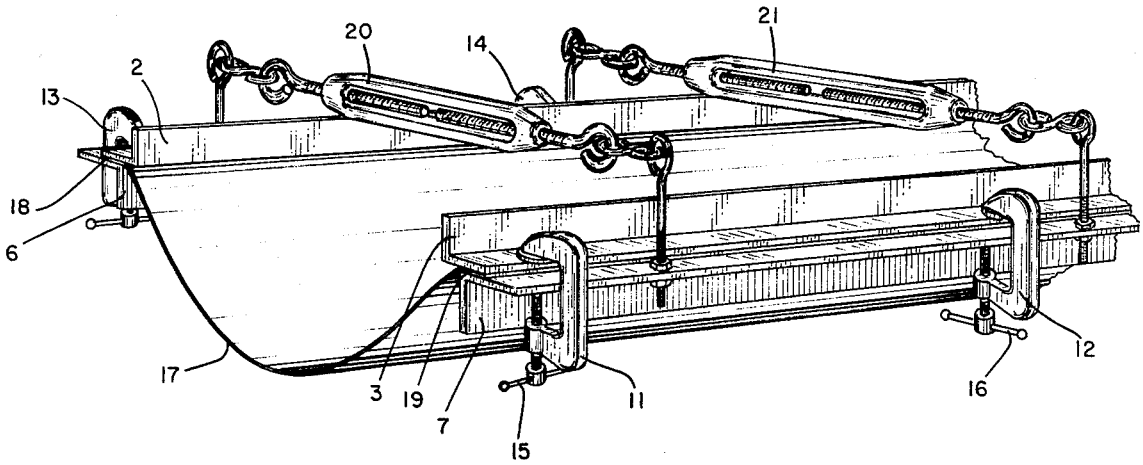
FIG. 1 is a perspective view of a portion of a trough having the bending elements in place.

Sheet metal having a cross section as shown in FIG. 2 is placed in the bending apparatus shown in FIG. 1, and is bent to parabolic shape shown in FIG. 1 by actuation of the turnbuckle bending devices. First, the sheet metal having the configuration of FIG. 2 is clamped in place between a set of elongated angle aluminum members. Upper angle members 2 and 3 rest on the tops of lips 4 and 5; lower angle members 6 and 7 are clamped to the lower edge of lips 4 and 5 by C-clamps 11, 12, 13, and 14.

Figure 3:
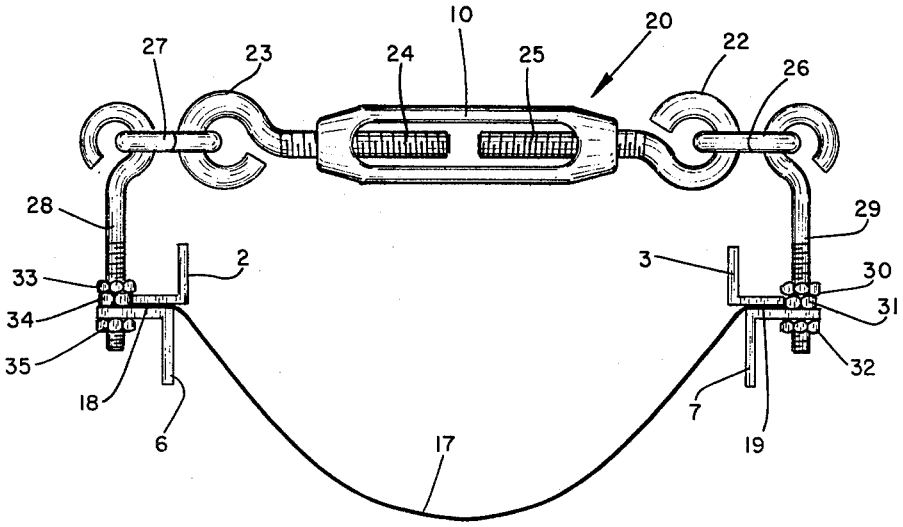
FIG. 3 is a side view of the turnbuckle bending element mounted on the trough.

The bending mechanisms are best seen in FIG. 3, showing shaped metal piece 17 having flanges 18 and 19. Turnbuckle 20 has link 10 threadedly engaged with shafts 24 and 25 of eye bolts 22 and 23. The turnbuckle is in turn attached through S-hooks 26 and 27 to vertical eye bolts 28 and 29. If the turnbuckle expanse at the commencement of bending is too short, an extension, such as a plurality of end-to-end S-hooks, may be used. The threaded shafts of eye bolts 28 and 29 are fastened to the horizontal flanges of lower aluminum angle members 6 and 7, respectively, and are held in place by nuts 30, 31, 32, 33, 34, and 35. Nuts 31 and 34 act as a stop for the sheet metal flanges; the other nuts are locking nuts.

Assembly and use of the bending apparatus is very simple. First the upper and lower angle members are clamped on to the flanges of the sheet metal piece. Eye bolts 28 and 29 are adjusted and locked into place to provide the proper bending moment on the sheet metal. Next, turnbuckles are attached to the eye bolts by the S-hooks. When all the assembly is in place, the turnbuckle links are turned in a clockwise direction, drawing the shafts 24 and 25 inwardly. Bending moments are applied to the sheet metal at the crease of the flanges, and, as turning of the turnbuckle continues, the cross section of the sheet metal assumes a parabolic shape.

The next step in the forming process of the invention is to relieve stress remaining in the metal after bending by heating. For the heating step, either the entire turnbuckle assembly (or an alternate equivalent, such as a pull-clamp) may be left in place, or preformed straps (not shown) which slide over the flanges to maintain the shape of the parabola during heating may be used. While the parabolic shell must be maintained in the desired shape by force at all times after the forming process and during the heating process, no special method of maintaining the parabolic form is necessary. Braces, straps, preformed cavities, or the like may all be used. The trough should be uniformly supported during heating, since the metal becomes quite soft and is easily deformed.

The conditions of stress relieving may vary widely depending on the type of metal used, metal thickness, heating temperature, heating time, and degree of stress. In general, engineering data are available showing the effect of temperature and time on the tensible yield strength of various metal alloys. The purpose of the heating step is to relax the metal to minimize springback, which is the tendency of stressed metal to return to its original shape prior to bending. For aluminum alloy 5052-H34, a temperture of 425°F. to 525°F. for a period of time of about ½ hour is most satisfactory. Surprisingly, although engineering data indicate that a temporary 84% reduction in yield strength would be expected from heating at about 600°F., springback is essentially negligible (about 0.2%). At about 525°F., even the harder H38 alloy has less than 0.45" springback per foot of aperture. "Aperture" is defined as the distance across the trough between the flanges. If desired, this small springback can be compensated for by overclosing the aperture to a slightly narrower opening than ultimately desired, such that when the trough is heated and the retention means subsequently removed, the slight springback will cause the trough to assume the desired cross section. Above 450°F., the springback causes no noticeable change in parabolic slope accuracy, and results only in a small change of the rim angle of the parabola. The term "rim angle" is used to refer to the angle formed by a line drawn through the vertex and focal point of the parabola with a line drawn through the focal point and a point on the upper rim of the trough.

In general, the process of the invention is especially useful for troughs having large rim angles, particularly parabolas having rim angles from 70° to about 115°, more preferably from about 90° to about 105°. Most known parabolic trough forming techniques are useful and accurate only for shallow troughs, i.e., troughs with smaller rim angles.

Because of the wide number of variables which influence control of the parabolic shape and springback associated with the forming process, a precise formula to control these variables is not available. The type of metal alloy used, the amount of bending moment applied, the thickness of the sheet metal, the angle of the flange bend, the desired rim angle, and the time and temperature of the heating step all influence the practical and economic control of the process. The preferred metal alloy used was aluminum alloy 5052-H34. This alloy appeared to give the optimum properties of low cost, high yield strength, moderate conditions of stress relief, good room temperature strengh, and very low springback. Other aluminum alloys, such as alloy 5052-H38 were used successfully; some alloys, such as 6061-T6 would be considerably less successful in that excessive heating time (over 10 hours) would be required to relieve springback. Commercially pure aluminum, and aluminum alloys designated by the 5000 series numbers are acceptable. Magnesium-based aluminum alloys are preferred; manganese-based alloys are acceptable but less desirable. Particularly desirable aluminum alloys have stress relief characteristics such that at reasonable temperatures, e.g. 400°–600° F., essentially no change in room temperature yield strength occurs after heat treatment for one hour, preferably one-half hour. In other words, the same strength loss occurs after one-half hour, 100 hours, and 1000 hours. Various mild steel alloys may also be used, though aluminum is preferred. In general, steel alloys require a somewhat higher stress relief temperature than the aluminum alloys, generally nearer 800° F. An example of an acceptable steel alloy is cold-rolled AISI 1025 steel sheet. Magnesium alloys (e.g., AZ31B-H24) may be used.

The thickness of the metal effects the cost, ability of the metal to conform to the ideal shape, and time required for stress relief. Thickness of the metal directly effects the limits of aperture widths. For troughs having apertures of about 2 meters and a thickness of 0.040" or less, the lack of rigidity of the trough creates a tendency of the material to assume a shape similar to a catenary when cold; after stress relief, this tendency is even more pronounced. Narrower aperture widths, e.g. about 1 foot, could be achieved satisfactorily with thinner material. It has been found that with aluminum alloy 5052-H38 , a thickness of 0.025" could produce a parabola with over a 13" aperture without significant deformation of the trough. With the same metal, a substantially greater thickness would be used for a trough having about a 6 foot aperture. While the thickness of the metal required depends importantly on the type of alloy used, in general it would be expected that a sheet thickness of from 0.020" to about 0.050", preferably from about 0.025" to about 0.040", would be preferred.

Control of the moments applied to the sheet metal at the juncture of the flange is affected by adjustment of the length of the moment arm above the directrix. Since the moment quantity is equal to force x distance, the moment is directly proportional to the distance between the flange and the point at which the turnbuckle exerts its force on the eye bolt, i.e., the point where the S-hook connects with the vertical eye bolt. It is extremely important to the forming process of the invention that the moments be substantially equal on each side of the tension means; otherwise, an uneven cross sectional curve will result. The equality of the moments on either side of the trough are maintained by the forming apparatus shown in FIG. 3 by permitting the S-hooks 26 and 27 to slide upwardly within the eye of eye bolts 28 and 29 as the bending process proceeds. At the beginning of the process, when the sheet metal is substantially flat, the eye bolts 28 and 29 assume a more horizontal position, and the S-hooks 26 and 27 interconnect with the eye bolts at a point near the shaft of the eye bolts. As the turnbuckle pulls the eye bolts into the configuration shown in FIG. 3, the point of interconnection of the S-hooks and the eye bolts gradually moves up to the position shown in FIG. 3. Accordingly, during the forming process, the movement of the S-hooks maintains an equal moment on each side of the trough. For most uses, moment arms of from 1 inch to 5 inches, preferably from 1 inch to 3 inches, are adequate for apertures of up to two feet. While many factors were found to influence the proper length of a moment arm, the effect of an overly long moment arm is to obtain a curve similar to a catenary curve and the effect of too short a moment arm is to obtain a curve more toward a "V" shape. For rim angles below 90°, these types of distortion are not a problem; however, as the rim angle increases above 90°, particular care must be used in selecting the proper moment arm.

The most important function of the heat treatment step is to control springback. The percentage springback is defined as the difference in the opening of the aperture of the parabola before and after release of the tension divided by the aperture opening prior to springback, multiplied by 100. While the time and temperature requirements for controlling springback vary considerably with the type, hardness, and thickness of alloy, it is desired to select conditions of time and temperature which will maintain the springback at less than 6%, and preferably less than 4%. At this level, the desired parabolic cross-section can be obtained by over-closing the aperture by a small amount equal to the projected springback. With this technique, parabolic cross sections of a desired shape and aperture can be obtained with a very high degree of accuracy.

The temperature of the heating oven is controlled at a sufficiently high level to minimize the time of exposure and amount of springback, but at a level sufficiently low such that yield strength on cooling is not reduced more than about 60%, preferably by not more than 30%, still more preferably not more than 10%. Heating times are controlled largely by commercial convenience; in most cases heating times of less than 1 hour, and preferably less than ½ hour are desirable. As an example, heating aluminum 5052-H34 alloy for ½ hour at a temperature from about 425°F. to about 525°F. will only reduce the room temperature tensile yield strength of the alloy by a maximum of about 20%; however, heating at higher temperatures will rapidly reduce the yield strength. As a comparison, heating aluminum alloy 6061-T6 for ½ hour at 500°F. will reduce the room temperature yield strength by about 50%. Accordingly, it is important to consult the appropriate engineering curves showing the effect of temperature on tensile yield strength when setting conditions of time and temperature.

The angle of the flange, seen best in FIG. 2, is also important. The flange is bent on a conventional brake machine. The ideal flange angle is ½ of the desired rim angle; for example, the ideal flange angle for a 105° rim angle parabola would be 52 ½°. In practice, some compensation is necessary because of the temperature changes occurring after room temperature flange formation. It is important that the two opposite flanges have the same angle of bend. Generally, a slightly greater angle than ½ of the desired rim angle is used to avoid any tendency for twisting the parabola out of shape when the end supports are bolted down for mounting the trough for use as a collector. For most commonly fabricated troughs, a flange angle of about 3° plus ½ of the rim angle is desirable.

Application of a reflective surface to the interior of the parabolic trough is accomplished by conventional means. For example, a layer of aluminized acrylic reflective material may be applied to the surface with an adhesive, or the surface may be coated with reflective material.

Since the amount of energy delivered to a receiver by the solar trough is a function of its geometric accuracy, the conformity of the shape of the parabolic troughs produced according to the invention was measured by a laser scan apparatus. This technique is described in Buter et al, "Optical Evaluation Techniques for Reflecting Solar Concentrators", Proceedings of the Society of Photo Optical Instrumentation Engineers, Volume 114, pages 43–49, 1977. According to this technique, a laser is translated across the aperture of the concentrator so that the beam is always normal to the plane of the aperture, and the reflected beam is intercepted by a photo detector array mounted at the theoretical focal point of the concentrator. Concentrations of about 8 to 1 were easily achieved, with a strong indication that ratios of 24 to 1 or greater can easily be achieved with slight improvements in the forming apparatus.

The invention is best understood with reference to the following Table, which includes actual examples of results achieved by the process of the invention.

TABLE

| | Length (ft.) | Aperture (in.) | Thickness (in.) | Rim Angle (deg.) | Temperature (°F.) | Heating Time (hr.) | Springback (in.) | Concentration |
|---|---|---|---|---|---|---|---|---|
| 1. | 6 | 8.25 | .037 | 105 | 450–500 | .5 | .125 | 8/1 |
| 2. | 6 | 8.3 | .032 | 107 | 485 | .3 | .34 | 8/1 |
| 3. | 6 | 8.3 | .032 | 107 | 485 | .3 | .34 | 8/1 |
| 4. | 1 | 13.1 | .040 | 104 | 530 | .3 | .50 | 13/1 |
| 5. | 1 | 13.1 | .040 | 104 | 530 | .4 | .47 | 24/1 |
| 6. | 1 | 13.1 | .040 | 107 | 600–625 | .3 | .01 | |
| 7. | 8 | 13.1 | .040 | 106 | 535 | .4 | .39 | 8/1 |

All examples in the table were fabricated from aluminum alloy 5052-H38 except Number 1, which was 5052-H34. Concentration ratio was based on aperture width to receiver circumference (rather than diameter).

The method of the invention is particularly adaptable to mass production techniques for concentrators having lengths of from about 1 to about 12 feet, and apertures from about 6 inches to about 24 inches. Mechanization of the bending step is a simple technique, and has been accomplished by a series of spaced lever-operated pull clamps. Heating is also easily automated, for example with the use of frames holding the stressed troughs being continuously loaded on the conveyor belt of a conventional continuous oven.

Another process design contemplates feeding continuous sheets of metal which have the edges gradually biased toward the desired shape by rollers. The entire forming apparatus could be maintained in an oven. Sections of desired length could be cut after cooling.

Many modifications and variations of the process of the invention are possible and will be apparent to those skilled in the art. The invention should not be considered limited to the specific embodiments disclosed in detail herein, but rather should be limited only by the following claims.

I claim:

1. A method of forming a parabolic trough from an elongated strip of sheet aluminum or aluminum alloy comprises applying forces inducing equal bending moments to each lengthwise edge of the strip until the sheet has achieved a predetermined parabolic cross-section having a rim angle of at least 70°, said forces being the sole forces applied to the strip during bending, and heating the strip to a temperature above 400°F. to substantially stress-relieve the metal while maintaining the strip in parabolic configuration.

2. The method of claim 1 wherein the heating occurs at a substantially constant temperature of from about 400°F. to about 600°F.

3. The method of claim 1 wherein the sheet metal is bent to a parabolic cross-section having a higher rim angle than the desired rim angle, the heating step is effected under conditions of time and temperature to only partially stress-relieve the metal, and the metal is cooled and relaxes to the desired rim angle.

4. The method of claim 3 wherein the heating conditions are controlled to permit relaxation of not greater than six percent of aperture of the trough.

5. The method of claim 1 wherein the parabolic cross-section of the trough has a rim angle of from about 70° to about 115°.

6. The method of claim 1 wherein the parabolic cross-section of the trough has a rim angle of from about 90° to about 105°.

7. The method of claim 1 wherein the trough has an aperture of from about 6" to about 24" and a length of from about 1" to about 12".

8. The method of claim 1 which comprises forming a flange along each long edge of the strip, and attaching bending apparatus to each flange prior to applying the bending moments.

9. The method of claim 1 wherein the strip is heated for less than about one hour.

* * * * *